United States Patent [19]

Russell

[11] Patent Number: 4,793,171

[45] Date of Patent: Dec. 27, 1988

[54] MULTI-SLIDE WIRE AND STRIP FORMING MACHINE

[75] Inventor: Frank S. Russell, Northboro, Mass.

[73] Assignee: Sleeper & Hartley Corp., Boston, Mass.

[21] Appl. No.: 163,655

[22] Filed: Mar. 3, 1988

Related U.S. Application Data

[63] Continuation of Ser. No. 761,189, Jul. 31, 1985, abandoned.

[51] Int. Cl.[4] ..... B21J 9/18

[52] U.S. Cl. ..... 72/449; 72/403; 72/381; 74/393; 83/313; 226/158; 226/165

[58] Field of Search ..... 53/389; 72/131, 337, 72/339, 403, 449, 135, 381, 383, 385; 74/393; 83/313; 226/152, 154, 156, 158, 141, 165

[56] References Cited

U.S. PATENT DOCUMENTS

| | | | |
|---|---|---|---|
| 2,861,635 | 11/1958 | Orr | 74/393 |
| 2,924,172 | 2/1960 | Buttner | 74/393 |
| 3,052,392 | 9/1962 | Vogt | 226/165 |
| 4,315,586 | 2/1982 | Dalamore | 226/158 |
| 4,347,961 | 9/1982 | Smith | 226/158 |
| 4,372,141 | 2/1983 | Russell et al. | 72/135 |
| 4,402,204 | 9/1983 | Russell et al. | 72/131 |
| 4,416,135 | 11/1983 | Russell | 72/130 |
| 4,523,449 | 6/1985 | Moriyama et al. | 226/165 |
| 4,524,597 | 6/1985 | Russell et al. | 72/135 |
| 4,528,831 | 7/1985 | Russell et al. | 72/131 |
| 4,607,513 | 8/1986 | Russell | 72/137 |

*Primary Examiner*—David Jones

*Attorney, Agent, or Firm*—Wolf, Greenfield & Sacks

[57] ABSTRACT

In a multi-slide wire and strip forming machine, an improvement that enhances the flexibility of the machine primarily from the standpoint of providing increased forming time relative to feeding time. The machine includes a wire forming means operable at the work station in response to the machine camshaft and operable over a predetermined forming. Wire feeding means is also included operable in response to the camshaft over a predetermined feeding period. An improved gearing arrangement is provided intercoupling the camshaft and the wire feeding means and configured to provide during a full camshaft rotation, different intervals of the predetermined forming and feeding periods, respectively.

19 Claims, 4 Drawing Sheets

MULTI-SLIDE WIRE AND STRIP FORMING MACHINE

This application is a continuation of application Ser. No. 761,189, filed July 31, 1985, now abandoned.

BACKGROUND OF THE INVENTION

The present invention relates in general to a multi-slide wire and strip forming machine typically referred to in the trade as a universal four-slide wire and strip forming machine. More particularly, the invention pertains to an improvement in such a multi-slide machine so as to provide for improved efficiency in wire and strip forming.

In the universal four-slide machine each of the slides support tooling configured and adapted to provide for the forming of wire or strips. In connection with this forming there may be provided a shaping tool. Each of the slides is operated from a cam which in turn is supported from a camshaft A feed mechanism is also provided. In this connection in the prior machine of the assignee herein there are a pair of circular gears, referred to as change gears that provide for drive from one of the camshafts through the pair of gears to a feed mechanism. Normally these change gears are of equal diameter thus providing a 1 to 1 gear ratio. This means that the shaft driving the feed mechanism rotates at the same rate as do the camshafts that operate the forming slides.

In the aforementioned arrangement the feed mechanism, also referred to as a feed slide moves forward advancing the wire or strip during 180° of rotation, and returns during the remaining 180° of rotation. The material whether it be wire or strip is gripped and fed during the forward 180° stroke.

With this arrangement the change gears may be removed so as to provide a 90° feed. In this case the change gears are in a ratio of 2 to 1 whereby the feed shaft rotates twice during each machine cycle. The feed gripper cam has only a 90° dwell for the 90° feed. Even though the feed slide makes two trips every cycle, the feed occurs only every other trip. This provides for 270° of forming time. However, this arrangement cuts the production speed roughly in half.

Other four-slide machines also incorporate a 90° feed systems but most of them accomplish it through the use of a complex cam arrangement. Also, such machines usually require additional linkages and are limited in production speed.

Accordingly, it is an object of the present invention to provide an improved multi-slide forming machine that is capable of operating at optimum production speed and which is furthermore capable of the construction of more complex wire and strip pieces by virtue of having an increased forming interval in comparison with the feed interval.

Another object of the present invention is to provide an improved multi-slide forming machine having improved flexibility of operation by virtue of providing control of the duration of respective forming and feeding intervals.

A further object of the present invention is to provide an improved multi-slide forming machine as in accordance with the preceding object and in which, for a single camshaft rotation, the forming time interval is greater than the feeding time interval, or alternatively, the feeding time interval is greater than the forming time interval.

Still a further object of the present invention is to provide an improved multi-slide forming machine that employs non-circular gear means intercoupling one of the machines camshafts with wire feeding means so as to provide a variable speed wire feed corresponding to constant speed rotation of the camshaft.

A further object of the present invention is to provide an improved multi-slide wire and strip forming machine that enables an increase in production speed even when constructing relatively complex piece configurations.

SUMMARY OF THE INVENTION

To accomplish the foregoing and other objects, features and advantages of the present invention, there is provided a multi-slide wire and strip forming machine that is improved in operation by virtue of increasing the ratio of forming time to feeding time while at the same time maintaining a high level of production speed. The machine of this invention comprises a machine frame and feed means supported in the frame and for selectively feeding either wire or strip material to a work station of the machine. The work station is considered to the area at which the slides (typically four slides) operate in forming a piece. This forming may be carried out by means of a forming tool. It is at the work station of the machine that certain feeding and forming steps occur. Typically, the feed is considered as occurring at a first part of the machine interval followed by a series of forming steps which usually include with a cutting step and then the cycle repeats itself with an initial feed interval followed by forming and cutting intervals. A camshaft means is provided, also supported in the machine frame and driven from a drive source which is typically an electric motor. Wire forming means is provided including means operable at the work station in response to rotation of the camshaft means. This forming ay be considered as being operable over a predetermined forming period. As indicated previously there is also provided a feed mechanism including means operable in response to the camshaft means rotation and operable over a predetermined feed period. Gear means intercouple the camshaft means and wire feeding means. This gear means is configured to provide, during a full camshaft rotation, different intervals of predetermined forming and feeding periods, respectively. Thus, in accordance with the present invention, there is provided a greatly enhanced flexibility of the machine by virtue of no longer being limited to 180° of forming and 180° of feeding. In accordance with the flexibility of the present invention and in accordance with a preferred form thereof, by the proper selection of the aforementioned gear means, one can provide a longer forming period in comparison with the feeding period. Alternatively, for some applications it may be desired to increase the feeding period in comparison with the forming period. As indicated, it is preferred to have an increased forming period as this leaves a segment of substantially greater than 180° through which to carry out the forming steps. This greatly enhances the flexibility of the overall machine. Alternatively, there may be situations in which the forming is not excessively complex but instead there is a desire to increase the overall speed of production. In such an instance the feeding can take place through a segment greater than 180° rotation of the camshaft employing the remaining segment for forming However, because the forming is relatively simple, then one is able to increase the speed of operation of the overall machine.

In accordance with the present invention, the aforementioned gear means preferably comprises non-circular gear means arranged to provide a forming period greater than the feeding period in the preferred embodiment herein. The forming period may be at least twice as along as the feeding period. In one specific example, the forming period is on the order of 250° of full camshaft rotation and the feeding period is on the order of 110° of full camshaft rotation In an alternate arrangement, the gear means may comprise non-circular gears arranged to provide a feeding period greater than the forming period. The gear means of the invention may comprise a pair of elliptical gears or alternatively may comprise other non-circular gear arrangements that provide the desired operation. With regard to the camshaft means previously mentioned, in a four-slide machine there is usually a main camshaft and then a pair of orthogonally disposed secondary camshaft. Double gear means may be employed for providing drive from the main camshaft to the secondary or auxiliary camshafts. As indicated previously each of these camshafts support one or more cams for controlling operation of the respective slides. One of the camshafts may also support a feed grip cam which is adapted to operate in conjunction with a feed eccentric arrangement. With regard to the non-circular gear means, it is noted that one of the auxiliary or secondary camshafts operates still a further camshaft preferably by way of bevel gears. It is on this latter camshaft that is mounted in the disclosed embodiment one of the non-circular gears. This gear in turn drives a second non-circular gear mounted upon a feed shaft which in turn drives the eccentric fee mechanism. The non-circular gear means provides variable speed wire feed corresponding to constant speed rotation of the camshaft. Thus, as the camshaft rotates through say, one third of its rotation, the gearing may be provided so that the feeding has progresses through and entire feeding sequence. Thus, during the remaining two thirds of camshaft rotation, one thus has available two thirds of a total revolution for carrying out forming steps.

Also, in accordance with the present invention there is provide an improved method of wire and strip forming, which method comprises the steps of operating feeding means through a period corresponding to less than one half of rotation of the camshaft and thereafter, in response to continued camshaft rotation, forming the wire or strip through the remaining interval which is greater than one half of the full rotation of the camshaft.

BRIEF DESCRIPTION OF THE DRAWINGS

Numerous other objects, features and advantages of the invention should now become apparent upon a reading of the following detailed description taken in conjunction with the accompanying drawings, in which:

FIG. 4 illustrates the initial feed, FIG. 5 illustrates the cutting and first forming step, FIG. 6 illustrates a subsequent forming step, FIG. 7 illustrates the final forming step and FIG. 8 illustrates the completed clip;

DETAILED DESCRIPTION

Figure 1:
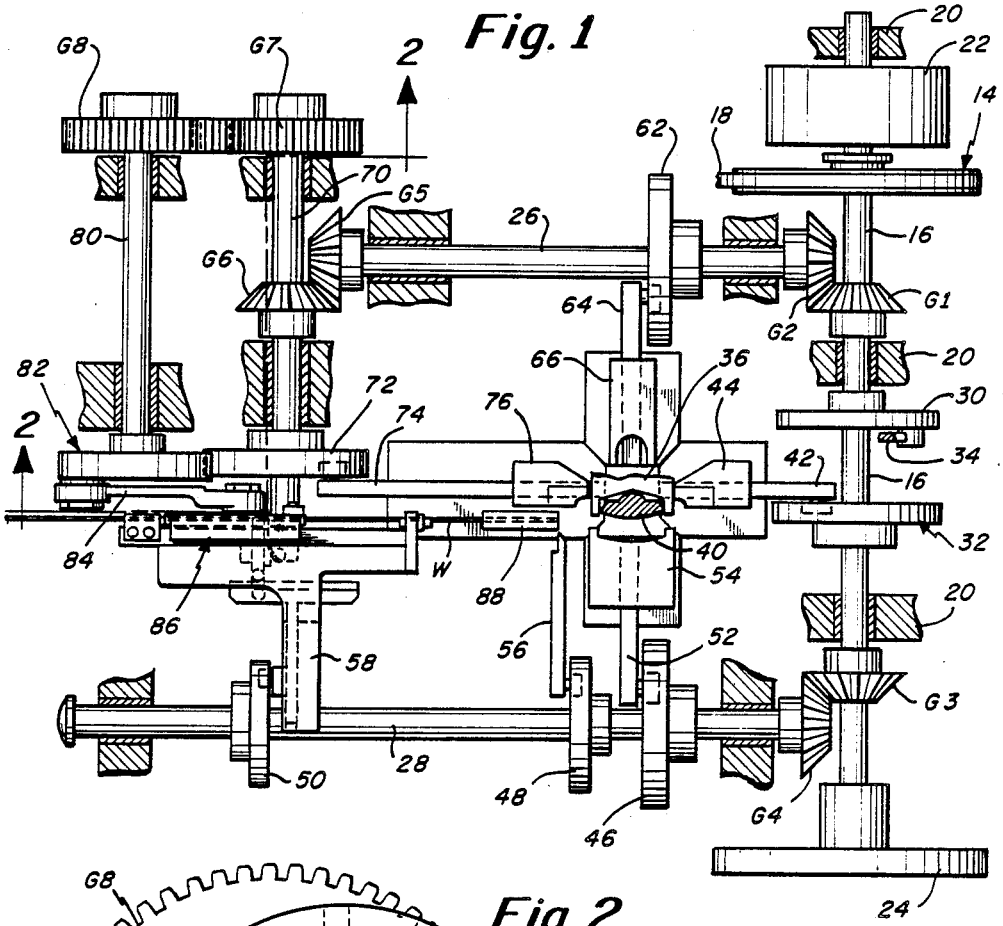
FIG. 1 is a plan view partially in cross-section illustrating a four-slide forming machine incorporating the principals of the present invention.
Figure 2:
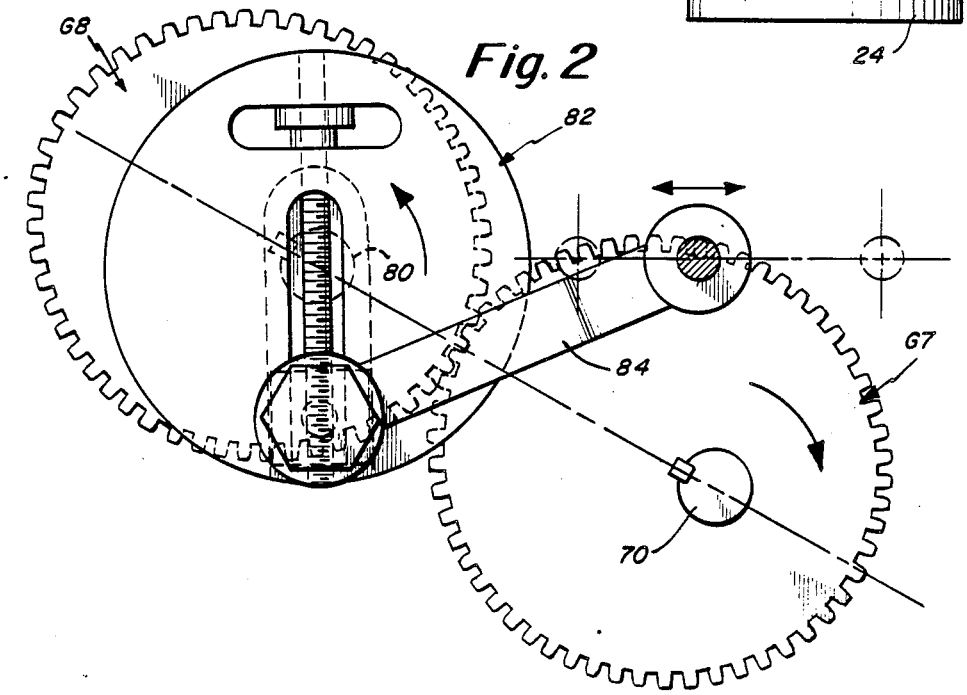
FIG. 2 is a cross-sectional view taken along line 2—2 of FIG. 1 illustrating the form of the non-circular gear means.
Figure 3:
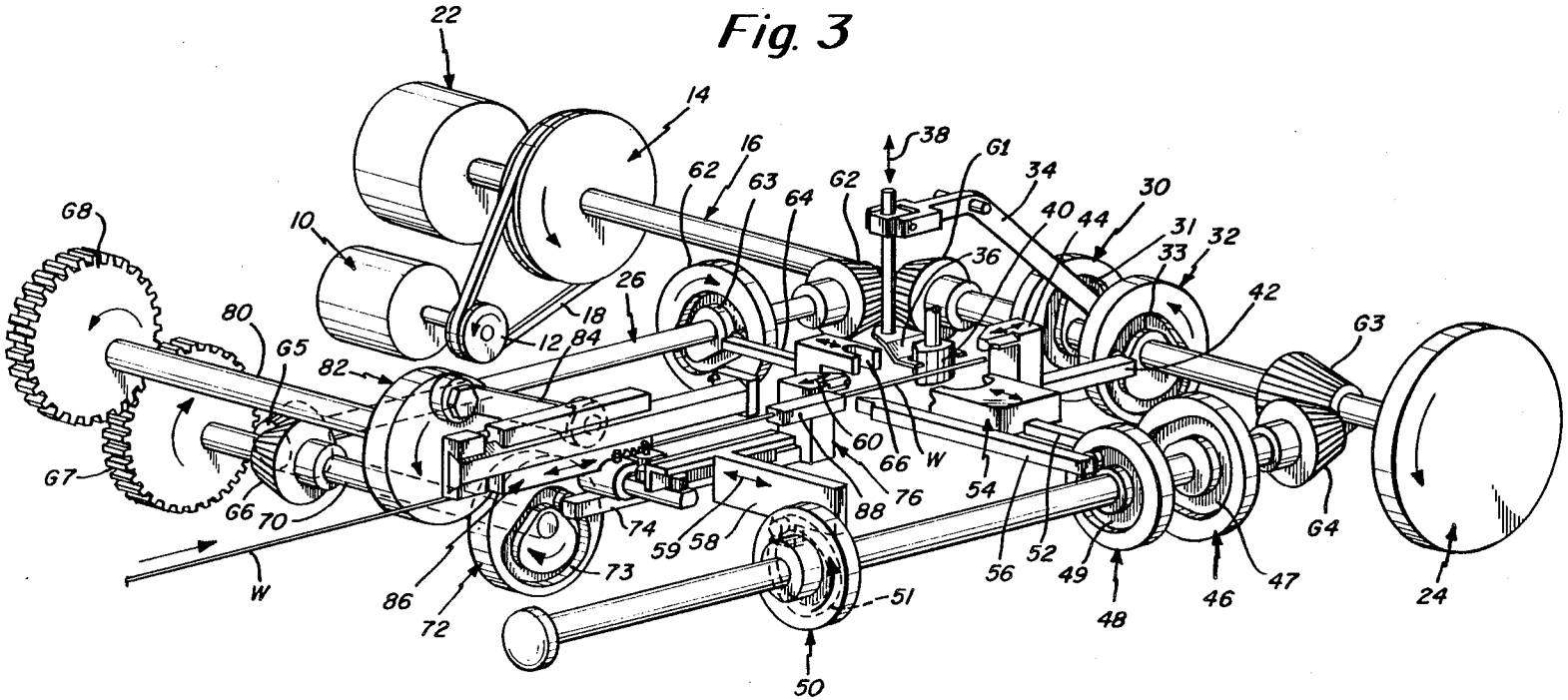
FIG. 3 is a perspective view showing the basic components and operation of the four-slide forming machine.

Reference is now made to FIGS. 1–3 that illustrate a machine incorporating the principals of the present invention and in particular adapted for operation in which the forming time in a sequence is greater than with previous constructions. Out of a 360° sequence the forming time can easily be extended to 250° with feeding occurring only over a 110° period. Furthermore, by proper selection of the non-circular gears of the invention the forming and feeding sequences can be established in a variety of different ratios.

With reference to FIGS. 1–3, it is noted that FIG. 1 is a plan view partially in cross-section illustrating the four-slide wire and strip forming machine that has been modified to incorporate the principals of the present invention. FIG. 3 is a perspective view also illustrating the primary components of the machine. Four slide machines of this type have generally been designed in the past with feed and forming sequences each of 180° or in other words of equal duration. In accordance with the present invention with the use of the non-circular gear means from a time standpoint the forming sequence can now be increased substantially in comparison to the time interval of the feed sequence.

In the machine illustrated in FIGS. 1–3 there is provided a drive motor 10 having at the output thereof a drive pulley 12. The pulley 12 is driven in the direction of the arrow illustrated in FIG. 3 associated therewith. The pulley 12 drives a larger pulley 14 which is secured to the shaft 16. The drive between the pulleys 12 and 14 is provided by a belt 18.

The shaft 16 as well as other shafts that are to be described hereinafter are all supported by bearings or bushings. In FIG. 3 for the sake of clarity these individual shaft supports are not illustrated. However, it is noted in FIG. 1 that shaft supports are illustrated in fragmentary cross section. These include, by way of example, the bushing shaft supports 20 associated with the shaft 16.

The main drive shaft 16 also has associated therewith a brake 22 at one end adjacent to the pulley 14. Also, at the other end of the main drive shaft 16 there is a flywheel 24. The main shaft 16 is also adapted to drive secondary shafts 26 and 28. For this purpose there is provided a first pair of beveled gears G1 and G2. The gear G1 is fixedly mounted to the shaft 16 and the gear G2 is mounted to an end of the shaft 26. There is thus provided through the beveled gears G1 and G2 direct drive from the shaft 16 to the shaft 26.

Similarly, there is a second pair of gears G3 and G4 that is adapted to provide drive from the shaft 16 to the secondary shaft 28. Gear G3 is fixedly mounted to the main drive shaft 16 and the gear G4 is mounted to an end of the secondary shaft 28.

On the main drive shaft 16 between the gears G1 and G3 there are mounted a pair of cams 30 and 32. The cam 30 has an inner race 31 and similarly the cam 32 has an inner race 33. The cam 30 by way of the cam follower 34 operates the tool 36. Tool 36 is a stripping tool that is generally adapted for motion in the direction of the arrow 38 in FIG. 3. For the most part the tool 36 is maintained in a position shown in FIG. 3 throughout the forming sequences and is moved downwardly for stripping the formed piece. It is noted that the stripping tool 36 is configured with spaced projections so as to substantially surround the shaping tool 40.

The aforementioned cam 32 mounted on the shaft 16 controls a further cam follower 42 which connects to and operates the right hand slide 44.

In the specific embodiment illustrated herein, each of the four slides that are to be described hereinafter have predetermined configurations which in the example given is for forming an alarm clock handle as will be illustrated in further detail hereinafter in FIGS. 4–8. However, it is understood that the slides may be selected in many different configurations for forming other items.

As indicated previously, the secondary shaft 28 which is suitably supported such as illustrated in FIG. 1 is driven from the main shaft 16 through the beveled gears G3 and G4. The gear G4 is secured to one end of the shaft 28. At intermediate positions along the shaft 28 there are provided a series of cams which comprise cams 46, 48 and 50. The cams 46, 48 and 50 each have respective inner races 47, 49 and 51. The cam 47 operates the cam follower 52 which in turn operates the front slide 54. The cam 48 operates the cut-off member 56. Lastly, the cam 50 operates the feed gripper mechanism 58 which is illustrated as being operated from the cam 50 in the direction of arrow 59. This controls the gripping of the wire as it is fed.

As indicated previously, the secondary shaft 26 is driven from the main shaft 16 through the gears G1 and G2. On the shaft 26 there is supported a single cam 62. The cam 62 has an inner race 63 that controls the movement of the cam follower 64. The cam follower 64 controls the movement of the rear slide 66.

Drive is also provided from the secondary shaft 26 to a shaft 70 that may be considered as a fourth camshaft and that support the gear G6. The shaft 70 also supports at one end the cam 72 and at the opposite end one of the non-circular gears in accordance with the present invention identified as gear G7. This gear may be an elliptical gear. Similarly, the gear G8 that meshes therewith may also be of elliptical shape.

The cam 72 has an inner race 73 that controls the cam follower 74. The cam follower 74 couples to the left hand slide 76 whose direction of movement is indicated by the arrow 60.

In summary, it is thus noted that the four slides 44, 54, 66 and 76 are all operated off of cams from the shafts 16, 26, 28 and 70. Attention is now directed to the feed control and in this connection, reference is made to the non-circular gears G7 and G8 as in accordance with the invention. The gear G8 is mounted to the shaft 80 at one end thereof. At the other end of the shaft 80 there is mounted the rotatable feed mechanism 82 which also includes the feed arm 84. The feed mechanism 82 which includes the feed slide 86 is adapted to work in cooperation with the feed gripping mechanism 58 to advance the wire W to the wire guide 88. In FIG. 3 it is noted that the wire W is illustrated as just having been fed to the work station and thus the four-slide forming machine is illustrated at an initial stage of forming.

Figure 4:
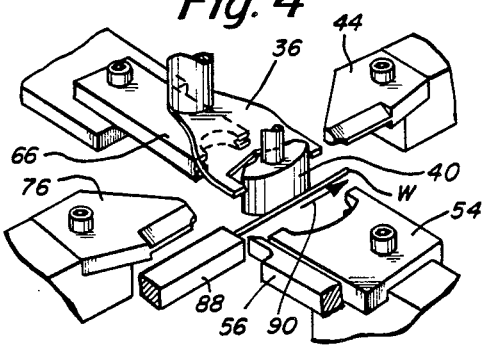
FIGS. 4–8 are perspective views each illustrating one step in a sequence for forming which in this case is a simple clip. In the sequence of FIGS. 4–8.

Reference is now made to FIGS. 4–8 that illustrate in a sequence, the steps that are carried out by the four-slide forming machine in constructing, in this case, an alarm clock handle. In FIG. 4 the four slides are shown in their retracted position disposed away from the central work area and disposed away from the shaping tool 40. The stripping tool 36 is shown disposed in an elevated position relative to the shaping tool 40. In FIG. 4 the wire W is being fed via the guide 88 in the direction of the arrow 90. As illustrated, the slide 54 is retracted away from the shaping tool 40 an the cutting mechanism 56 is also disposed away from the wire W.

Figure 5:
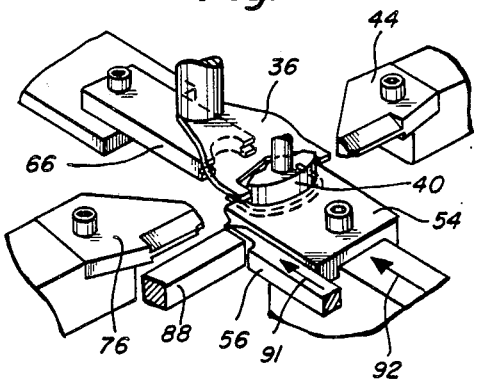

In a subsequent step as illustrated in FIG. 5, the cutter 56 has moved in the direction of the arrow 91 to cut the wire W. Thereafter, the slide 54 is moved in the direction of arrow 92 to provide a first bend in the wire W. The slide 54 carries a tool that provides an arcuate bend and the shape of which conforms to the shape of the shaping tool 40 as noted in FIG. 5. As a matter of fact, FIG. 5 and the other drawings clearly illustrate all of the particular tool constructions that are employed each associated with one of the particular slides. It is also indicated previously, different tool configurations may be employed depending upon the particular configuration of the item being formed.

Figure 6:
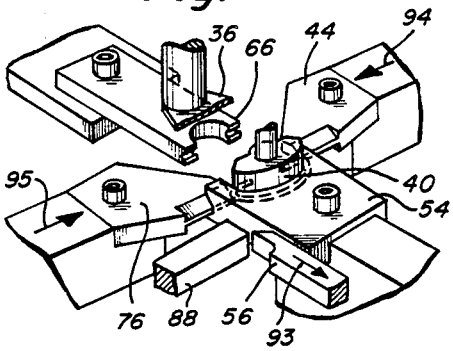

FIG. 6 shows the cutting mechanism 56 being retracted in the direction of the arrow 93. Also, in FIG. 6 the left and right hand slides are shown being operated. Thus, the slides 44 and 76 are moved toward the work station and the tools associated therewith provide a reverse bend essentially about the back side of the shaping tool 40. The left and right slides are illustrated as moving in the direction of arrows 94 and 95.

Figure 7:
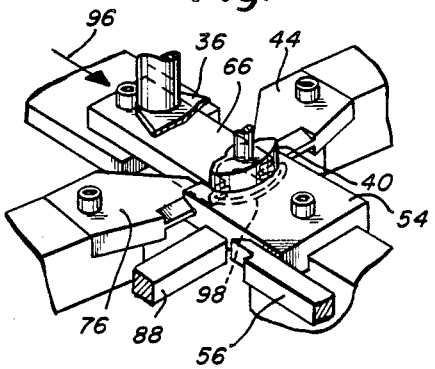

Next, the sequence of FIG. 7 shows the left and right slides maintained in position while the rear slide 66 and its associated tool provides for the proper forming of the very ends of the alarm clock handle. FIG. 7 illustrates the movement of the rear slide in the direction of the arrow 96.

Figure 8:
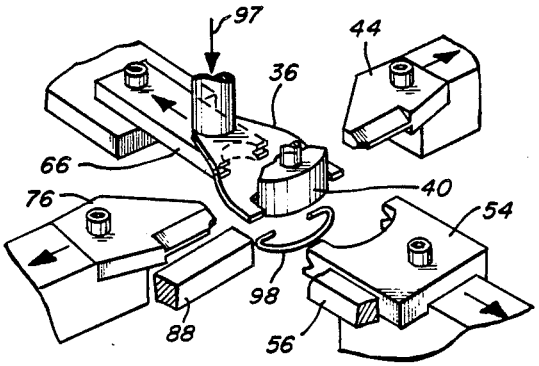

Finally, in FIG. 8 all of the slides are moved outwardly away from the work station because the handle has now been completely formed. After the slide have been removed then the stripping tool 36 is moved downwardly in the direction of arrow 97 causing the handle 98 to be stripped from the shaping tool 40. This completes the sequence of forming in connection with this particular item.

Figure 9:
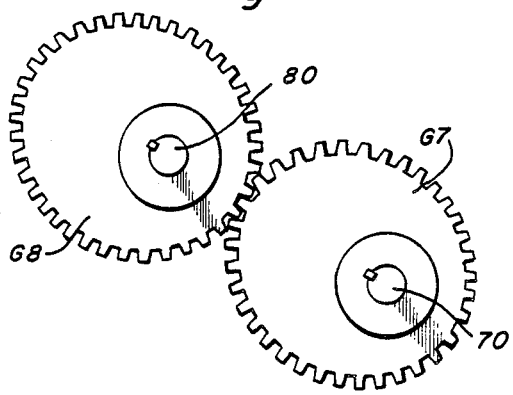
FIG. 9 illustrates one interengagement position between the non-circular gears corresponding to an increased forming period in comparison with the feeding period.

Reference is now made to FIG. 9 which shows the gears G7 and G8 on their respective shafts 70 and 80. It is noted in FIG. 9 that these gears are illustrated at their position in the middle of the feed sequence in which the gear G7 is at its maximum radius relative to the shaft 70 while the gear G8 is at its minimum radius relative to the shaft 80. This provides a form time interval that may be on the order of 250° out of the full 360° rotation of the camshaft. The rotation of the shaft 70 is representative of camshaft rotation. Similarly, there is a feed time interval that is on the order of 110° out of the full 360° interval.

Reference has been made to a forming interval of 250° and a feed interval of 110°. Of course, these intervals can vary and in this connection reference is made to FIG. 10 which shows a form interval at 100 which may extend through an angle on the order of 24°. The feed interval at 102 is thus through an angle of 120°. These variable form and feed intervals may be arrived at by changing the overall elliptical shape of the gears G7 and G8.

Figure 10:
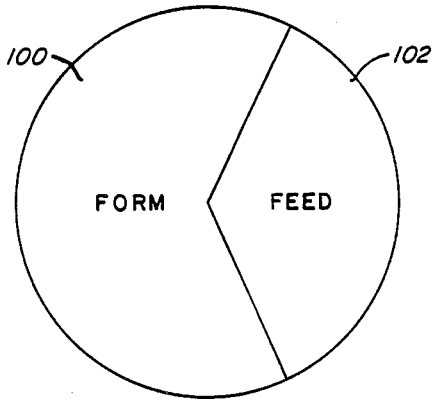
FIG. 10 is a schematic diagram illustrating the larger forming period in comparison with the feeding period.

In connection with the embodiment illustrated in FIGS. 9 and 10 in which the form interval is greater than the feed interval, it is noted as has been mentioned previously that the gears are illustrated in FIG. 9 at the middle of the feed interval. In this instance the instantaneous gear ratio between the gears G7 and G8 provides for a more rapid feed per rotation of the shaft 80 in comparison with the rotation of the shaft 70. In other words, for a 110° rotation of the shaft 70 the shaft 80 may complete a rotation on the order of 180° thus meaning that the feed step controlled at the shaft 80 is completed in only 110° rotation of the camshaft 70. Essentially, the difference in the radius of the gear as measured from the shaft in each instance determines, along with the gear shape, how the form and feed intervals may vary. However, in any instance in which the gears are in an arrangement as illustrated in FIG. 9 the form interval is greater than the feed interval.

Figure 11:
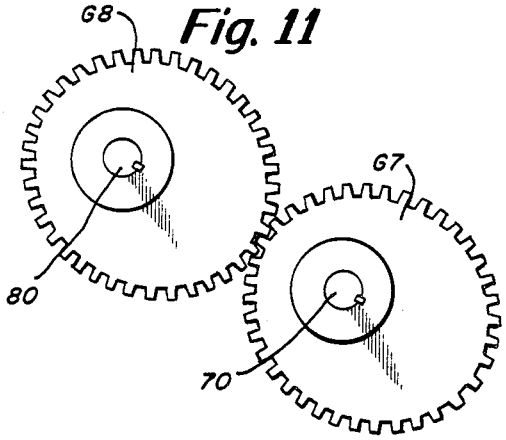
FIG. 11 illustrates the non-circular gear engagement in connection with an increased feeding period in comparison with the forming period.
Figure 12:
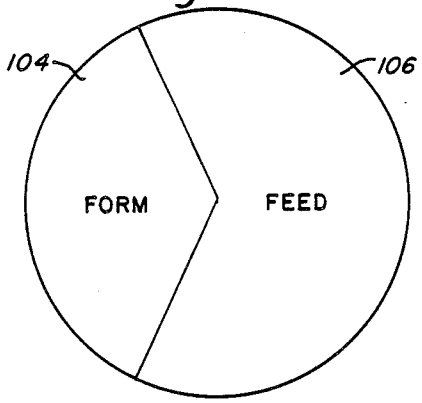
FIG. 12 is a schematic diagram illustrating the increased feed period in comparison with the forming period.

Now, FIG. 11 illustrates an alternate form of control that may be desired in some instances in which the form time is decreased relative to the feed time. In this connection refer to FIG. 12 which shows the form interval 104 as being less than the feed interval 106. The form interval illustrated in FIG. 12 may be on the order of 120° of rotation while the feed interval may be on the order of 240° of rotation.

With reference to FIG. 11 it is noted that the position of the gears G7 and G8 are now essentially reversed. In FIG. 11 these gears are again shown at the mid point of their feed sequence but in this case now the relative radii have been reversed so that the feeding occurs over a greater segment of camshaft rotation, or in other words a greater segment of rotation of the shaft 70 in FIG. 11.

Again, in FIG. 11 it is noted that at the mid point of feed the gear G7 has its smallest radius as mentioned from the shaft 70 while the gear G8 at its maximum radius as mentioned from the shaft 80. This means that the feed shaft is essentially turning slower for each segment of turn of the camshaft 70 thus providing a feed that is over a larger segment of camshaft rotation than is devoted to forming.

Having described a limited number of embodiments of the present invention, it should now be apparent to those skilled in the art that numerous other embodiments are contemplated as falling within the scope of the present invention. For example, one example has been illustrated herein regarding the type of item or piece that can be formed with the machine incorporating the principals of the present invention. In addition, many other types of pieces can be formed depending upon the configuration and placement of the tools associated with the slides. Also, there have been described herein no-circular gear means in the form of a pair of elliptical gears. Alternatively, the gears could be of other non-circular form other than elliptical. Moreover, the non-circular gear means may also encompass a gear arrangement in which one of the gears is non-circular while the other is circular. Also, one form of a four-slide forming machine has been illustrated but the principals of the present invention may also be used in connection with other types of multi-slide forming machines.

What is claimed is:

1. A multi-slide wire and strip forming machine comprising;

a machine frame, feed means supported from the frame and for selectively feeding wire to a work station of the machine, camshaft means supported from the frame, a drive source for driving said camshaft means, wire forming means including multiple slide means operable at said work station in response to said camshaft means and over a predetermined forming period, said wire feed means including a feed mechanism and control shaft means operable in response to said camshaft means and over a predetermined feeding period, and non-circular gear means intercoupling the camshaft means and wire feeding means control shaft and configured to provide, during a full camshaft means rotation, said predetermined forming period greater than said predetermined feeding period, said forming and feeding intervals associated with forming an item being completed in a single camshaft means rotation, said wire forming means comprising follower means operable from said camshaft means for controlling each of said sliding means in a sequence to form an item, said predetermined forming period and said predetermined feeding period being respectively mutually exclusive.

2. A multi-slide wire and strip forming machine as set forth in claim 1 wherein said feeding means comprises an eccentric feed mechanism.

3. A multi-slide wire and strip forming machine as set forth in claim 1 wherein said drive source comprises a motor mounted in said machine frame.

4. A multi-slide wire and strip forming machine as set forth in claim I wherein said wire forming means includes at least one forming or shaping tool.

5. A multi-slide wire and strip forming machine as set forth in claim 1 wherein said wire feeding means includes an eccentric feeding mechanism and wire gripper means.

6. A multi-slide wire and strip forming machine as set forth in claim 1 wherein said forming period is at least twice as long as said feeding period.

7. A multi-slide wire and strip forming machine as set forth in claim 6 wherein said forming period is on the order of 250° of full camshaft means rotation, and said feeding period is on the order of 110° of full camshaft means rotation.

8. A multi-slide wire and strip forming machine as set forth in claim 1 wherein said gear means comprises a pair of elliptical gears.

9. A multi-slide wire and strip forming machine as set forth in claim 1 wherein said feeding means comprises a feed mechanism including an eccentric crank.

10. A multi-slide wire and strip forming machine as set forth in claim 1 wherein said camshaft means comprises at least one main camshaft having at least one cam and at least a pair of secondary camshafts also each carrying at least one cam.

11. A multi-slide wire and strip forming machine as set forth in claim 10 including beveled gear means for providing drive between the main camshaft and the secondary camshafts.

12. A multi-slide wire and strip forming machine as set forth in claim 11 including a fourth camshaft driven from one of said secondary camshafts.

13. A multi-slide wire and strip forming machine as set forth in claim 12 wherein said non-circular gear means comprises a pair of non-circular gears, one of which is mounted on said fourth camshaft.

14. A multi-slide wire and strip forming machine as set forth in claim 13 including a feed shaft for mounting said other non-circular gear.

15. A multi-slide wire and strip forming machine as set forth in claim 14 wherein the cams on the main shaft and three auxiliary shafts operate the slides of the multi-slide machine.

16. A multi-slide wire and strip forming machine as set forth in claim 1 wherein said non-circular gear means comprises elliptical gear means.

17. A multi-slide wire and strip forming machine as set forth in claim 1 wherein said wire feed means comprises follower means operable from said non-circular gear means for controlling the feeding of wire or strip to a work station of the machine during a feeding period that is less in duration than the forming period.

18. A multi-slide wire and strip forming machine as set forth in claim 17 wherein said feed means comprises a wire slide means only operable during the feed period whereby the forming occurs during the forming period without any wire or strip feed.

19. A multi-slide wire and strip forming machine as set forth in claim 18 wherein said non-circular gear means comprises first and second intermeshed gears, and further including a first shaft driven from said cam shaft means for supporting said first gear in a second shaft supporting said second gear and for driving said feed means.

* * * * *